US006888110B2

(12) United States Patent
Baier et al.

(10) Patent No.: US 6,888,110 B2
(45) Date of Patent: May 3, 2005

(54) METHOD AND DEVICE FOR DETECTING HEATING PROCESSES

(75) Inventors: Martin Baier, Ettlingen (DE); Wolfgang Wittenhagen, Gundelsheim (DE); Ralf Dorwarth, Oberderdingen (DE)

(73) Assignee: E.G.O. Elektro-Geraetebau GmbH (DE)

( * ) Notice: Subject to any disclaimer, the term of this patent is extended or adjusted under 35 U.S.C. 154(b) by 0 days.

(21) Appl. No.: 10/877,610

(22) Filed: Jun. 25, 2004

(65) Prior Publication Data

US 2004/0262292 A1 Dec. 30, 2004

(30) Foreign Application Priority Data

Jun. 27, 2003 (DE) ..... 103 29 840

(51) Int. Cl.[7] ..... H05B 1/02

(52) U.S. Cl. ..... 219/494; 219/497; 219/492; 219/448.17; 99/332; 374/102

(58) Field of Search ..... 219/490, 492, 219/494, 497, 501, 506, 412–414, 448.11, 448.17; 374/101–103; 340/589; 99/325–331

(56) References Cited

U.S. PATENT DOCUMENTS 4,816,647 A * 3/1989 Payne ..... 219/448.12
5,324,917 A 6/1994 Boyer et al.
5,711,606 A * 1/1998 Koether ..... 374/149
6,300,606 B1 10/2001 Engelmann et al.
6,384,384 B1 * 5/2002 Connolly et al. ..... 219/481
6,469,282 B1 10/2002 Roberts
2004/0159650 A1 8/2004 Steiner et al.

FOREIGN PATENT DOCUMENTS

DE 195 44 652 A1 6/1997
DE 196 48 196 A1 11/1997
EP 08 06 887 A1 11/1997
WO WO 95/16230 A1 6/1995

* cited by examiner

*Primary Examiner*—Mark Paschall
(74) *Attorney, Agent, or Firm*—Akerman Senterfitt

(57) ABSTRACT

A method and the associated device for detecting cooking or boiling processes in a glass ceramic hob are described, to which power is supplied by a power supply by means of a heating element and said power is transmitted to the cooking vessel standing thereon. During a cooking process a temperature profile of the hob is measured and evaluated. The temperature profile is evaluated after ending the power supply and for evaluation purposes a temperature profile gradient is determined. During evaluation, a normal cooking or boiling process is detected if the gradient exceeds a predetermined threshold. During evaluation, a disturbed or faulty cooking or boiling process is detected if the gradient is equal to or smaller than a predetermined threshold. Such a disturbed or faulty cooking or boiling process can arise through the cooking vessel boiling dry or empty.

16 Claims, 3 Drawing Sheets

METHOD AND DEVICE FOR DETECTING HEATING PROCESSES

FIELD OF APPLICATION AND PRIOR ART

The invention relates to a method for detecting heating processes in the case of a hotplate or hob and to a device for detecting heating processes in the case of a hotplate or hob, such as can e.g. be used for the aforementioned method.

It is known to provide an operating temperature limitation for protecting the hob in connection with hobs and in particular glass ceramic hobs. For this purpose it is known to use rod-type thermostats or also electronic operating temperature limiters with temperature sensors. Through the known operating temperature limiters it is also possible to detect faulty or disturbed heating processes such as an empty heating process, i.e. heating of an empty hob, and/or a dry heating process. This means that a cooking product has completely boiled away in a cooking or boiling vessel and there is no longer any cooking product in said vessel.

U.S. Pat. No. 6,469,282 B1 discloses a method and a device for the detection of faulty heating processes in the case of a hob, where for the detection of a faulty heating process, particularly a dry heating process, during operation with limited power the power consumption of the heating element is evaluated. Thus, boiling dry is detected by a marked drop in the power consumption of the heating element and the associated signal. If the hob is not operated in a power limiting mode, a faulty heating process is also detected by the evaluation of a temperature signal. A faulty heating process is detected if there is a marked temperature signal rise.

EP 1391141 A1 discloses a method and a device for detecting in the case of a hob a faulty heating process, particularly an empty heating process, where there is no saucepan on the hob. In the described method a faulty heating process is detected by evaluating a switching temperature-time profile in power limiting operation and this is compared with the stored switching temperature-time profiles. One of the stored switching temperature-time profiles corresponds to a switching temperature-time profile of an empty boiling process.

U.S. Pat. No. 6,384,384 B1 discloses a method and a device for detecting faulty heating processes in a hob, in which for the detection of a faulty heating process, particularly a dry heating process, in operation with limited power an evaluation of the power consumption of a heating element is carried out. A boiling dry is detected by a pronounced drop in the power consumption of the heating element and the associated signal. For the evaluation of the signal representing the power consumption, a first and second derivatives of the power consumption signal are determined and evaluated. A faulty heating process is detected if the evaluation of the first and second derivations indicate a marked drop in the power consumption signal. If the hob is not operated in the power limiting mode, a faulty heating process is also detected by the evaluation of a temperature signal. Such a faulty heating process is detected if the first and second derivatives of the temperature signal indicate a pronounced rise in the temperature signal.

PROBLEM AND SOLUTION

The problem of the invention is to provide a method for determining heating processes and to a device for performing the method, which has a simple construction and enabling the reliable detection of faulty heating processes, also in a power limiting mode.

This problem is solved by a method according to claim 1 and a device according to claim 13. Advantageous and preferred developments of the invention form the subject matter of the further claims and are explained in greater detail hereinafter. By express reference the wording of the claims is made into part of the content of the description.

The fundamental idea of the invention is to evaluate a temperature profile of a cover for heating devices or a temperature profile of a hotplate or hob in order to determine heating processes. This is carried out if the power supply to at least one heating element is reduced or ended, particularly following an interval. For this purpose a gradient of the temperature profile, particularly in the falling range, in order to evaluate the temperature profile. During evaluation a normal heating process is detected if the gradient exceeds a predetermined threshold. If the gradient is equal to or lower than a predetermined threshold, a faulty heating process or operation is detected during evaluation.

The power supply to the at least one heating element is interrupted on reaching an assigned temperature of the cover and/or following assigned time intervals. Time intervals during which power is supplied to the heating element and time intervals during which no power is supplied to the heating element alternate. The time intervals can reciprocally behave as for the timing of radiant heaters. The assigned temperature can be a maximum temperature to which the cover can be exposed and/or a temperature assigned by a control means as a function of a user input.

The evaluation of the temperature profile following the disconnection of the power supply or following the end of an interval at the heating element is based on the idea that a cooking or boiling vessel located on the cover continues to extract power from the latter even when the power supply is disconnected during a cooking or boiling process. This process brings about a drop in the cover temperature and this can be evaluated. If there is a considerable drop, it can be concluded therefrom that there is still cooking product in the cooking vessel, because both together still absorb a large amount of power. If the drop is small, it can be concluded that there is little or no cooking product in the cooking vessel and that consequently the latter only consumes little or even no power.

Thus, in advantageous manner, through the evaluation of the temperature profile, which must in any case be determined for temperature control purposes, a normal heating process can be distinguished from a faulty heating process. No additional components are required for this purpose, such as a subassembly for determining the power consumption, for example.

It is particularly advantageous if the nature of the curve shape of the temperature drop is roughly known. It can correspond to a decaying exponential function. If this is theoretically generally known, from two points it is possible to reach conclusions with respect to the specific curve function and therefore the further shape. From the specific curve shape or the shape function conclusions can in turn be drawn regarding parameters of the decaying process, such as time constants or the like. These provide information on the nature of the decaying process and consequently the state of the cover or the cooking vessel resting thereon.

However, it is also possible to determine several points of the curve during the drop. This can be compared with known, stored curve shapes to enable conclusions to be drawn concerning the present curve shape.

According to an advantageous further development of the invention, when a disturbed or faulty heating process has been detected an alarm can be triggered or the power supply can be reduced and/or disconnected.

In a particularly advantageous further development of the invention, during the evaluation of the temperature profile, the currently determined gradient is compared with gradients determined at an earlier time. During the described comparison, if the current gradient exceeds the earlier gradient, a first heating process is detected, in which the cooking vessel with the cooking product still absorbs much power and from this it can be concluded that the cooking product has not yet boiled.

If the current gradient and the earlier gradient are substantially equal, then during evaluation a second heating process is detected, in which the cooking vessel with the cooking product in the current time interval following the ending of the power supply absorbs the same power as in an earlier time interval following an earlier ending of the power supply. Thus, the power consumption of the cooking or boiling vessel with the cooking product is roughly the same over a longer time period and from this it can be concluded that the cooking product is boiling.

If the current gradient is lower than the earlier gradient, then during evaluation a third heating process is detected. In the latter the cooking vessel with the cooking product absorbs less power. From this it can be concluded that the cooking product has boiled away or that the cooking vessel has boiled empty or dry and a dry heating process exists. This is looked upon as a critical state.

For determining the gradient of the temperature profile preferably several points of the temperature profile are measured and evaluated at time intervals. For example, a first point is measured just after the end of the power supply interval and a second point shortly before the recommencement of the power supply.

An important advantage of the method according to the invention is that no information or memories of absolute temperature values are needed in order to differentiate the different heating processes. The method only evaluates the tendency of "stronger" or "weaker" temperature profile drops during the heating intervals, these are the time intervals during which the heater receives no power. Through the comparison of the currently determined gradient with a previously determined gradient, it is advantageously possible to detect and differentiate different normal heating processes in addition to the detection of faulty heating processes.

The inventive device for the detection of heating processes in connection with a hotplate or hob comprises a cover and a heater placed under the cover for the power supply to a cooking or boiling vessel placed on the cover. It is also possible to provide a power supply for supplying power to the heater and which is controlled by a control means. During a heating process a temperature sensor measures a temperature profile of the cover. The control means is constructed for evaluating the measured temperature profile in such a way that it evaluates the temperature profile after the ending of the power supply. For evaluation purposes it determines a gradient of the temperature profile. During evaluation and as described hereinbefore, a normal heating process is detected if the gradient exceeds a predetermined threshold. If the gradient is equal to or smaller than a predetermined threshold, a faulty heating process is detected during evaluation.

It is additionally possible to provide an alarm device, which can be activated by the control means following a detected, faulty heating process. Moreover, following a detected, faulty heating process, the control means can reduce and/or disconnect the power supply with a switching device. Advantageously the temperature is located on that side of the cover to which the heater is fitted. The temperature sensor can also be fitted or engaged directly on the cover.

These and further features can be gathered from the claims, description and drawings and the individual features, both singly or in the form of sub-combinations, can be implemented in an embodiment of the invention and in other fields and can represent advantageous, independently protectable constructions for which protection is claimed here. The subdivision of the application into individual sections and the subheadings in no way restrict the general validity of the statements made thereunder.

BRIEF DESCRIPTION OF THE DRAWINGS

An advantageous embodiment of the invention described hereinafter is diagrammatically illustrated by the drawings, wherein show.

DETAILED DESCRIPTION OF THE EMBODIMENT

Figure 1:
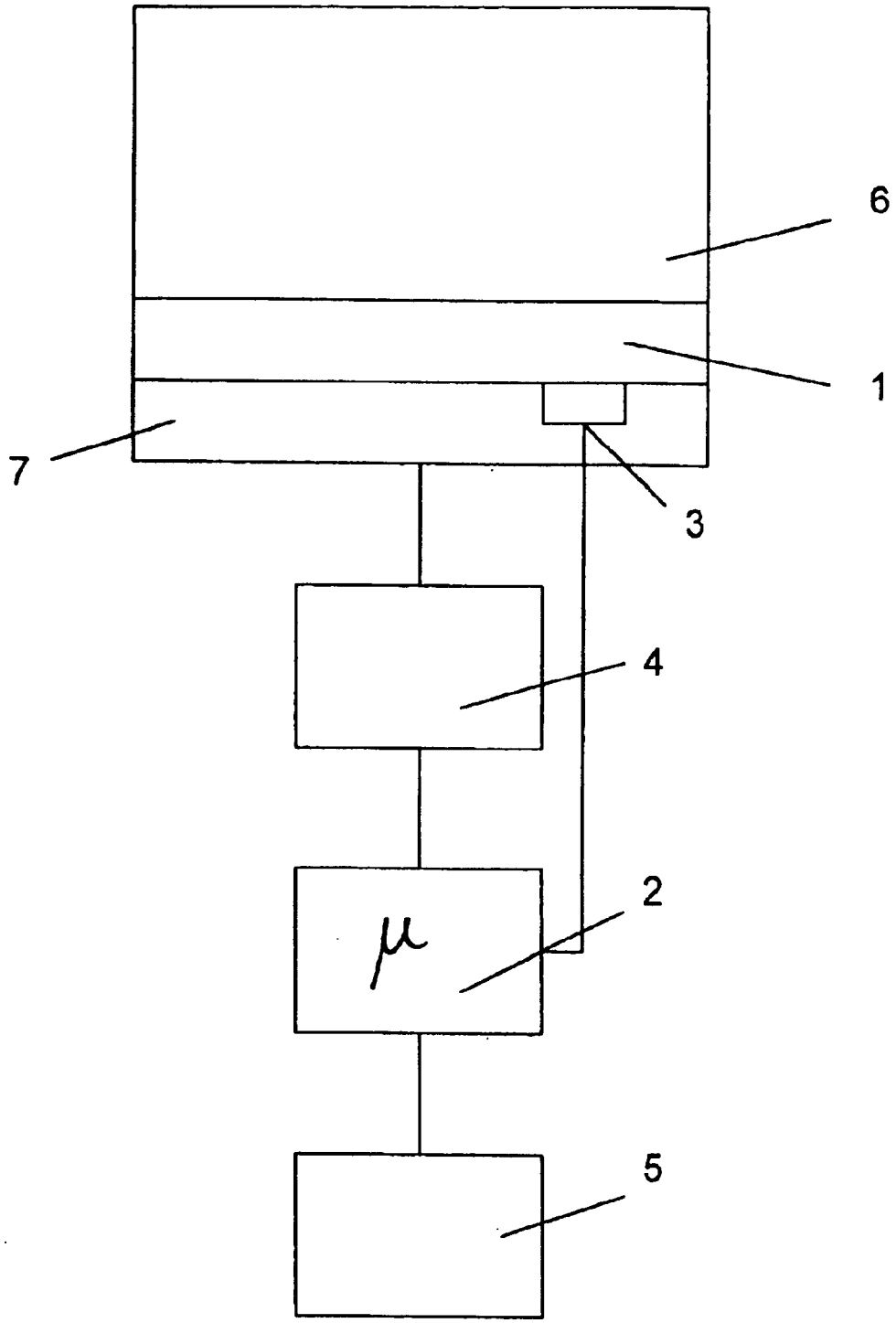
FIG. 1 A block diagram of a device according to the invention.

As can be gathered from FIG. 1, the device for detecting heating processes according to the invention comprises a glass ceramic hob 1 for a hotplate or hob, a control means 2, a temperature sensor 3, a power supply 4, a heater 7 and a control panel 5. The power supply 4 is controlled by the control means 2 and supplies power to the glass ceramic hob 1 by means of heater 7 and said power is transmitted to a cooking or boiling vessel 6. The power supply takes place in timed manner, preferably with an assigned power and with substantially fixed cycle times, which are dependent on the level of the chosen power supply, e.g. as a cooking or boiling stage.

During a cooking or boiling process, the temperature sensor 3 measures a temperature profile of the cover 1 and the control means 2 evaluates the measured temperature profile. The temperature sensor 3 is fitted to that side of the cover 1 on which the heater 7 is located. For evaluation and following the ending of the power supply, the control means 2 determines a gradient GN of the temperature pattern with the above-described measures and possibilities.

Figure 2:
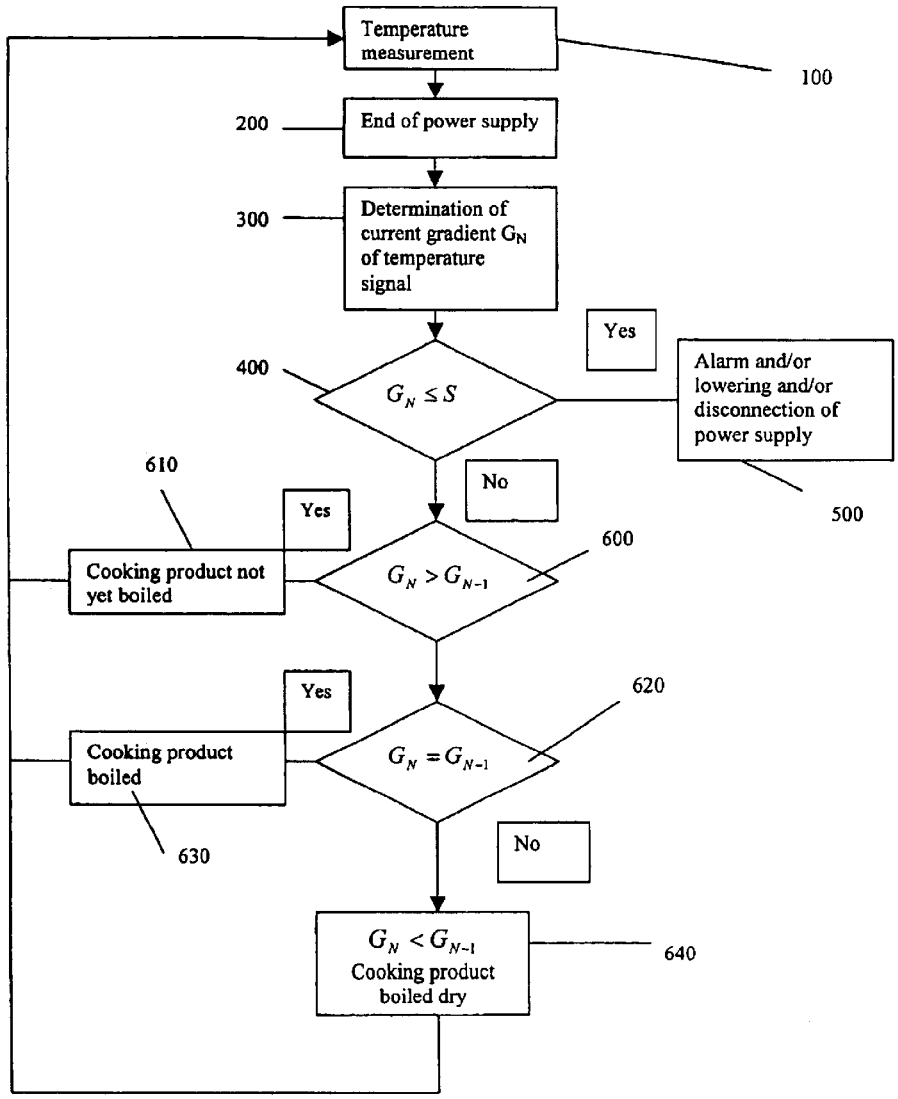
FIG. 2 A flow chart of a method for detecting heating processes according to the invention.

As is apparent from FIG. 2, in the case of the heating process detection method according to the invention in connection with a hotplate or hob, particularly a glass ceramic hob, during step 100 determination takes place of a temperature profile of a cover of the hotplate or hob by means of a temperature measurement performed by a temperature sensor 3. Preferably, during the temperature measurement, at time intervals points of the temperature profile are measured.

In step 200, the ending of a power supply interval for a heating element 3 is established, e.g. because the hob has reached an assigned temperature, or because an assigned time interval for the power supply has elapsed. Then, in step 300, a drop in the hob temperature is determined in the form of a current gradient GN as a result of the ending of the power supply. For determining the gradient GN use is made of several measured points of the temperature profile. Preferably two points are used, one just before the end of the power supply and one just before the recommencement of the power supply.

In step 400 the current gradient GN is compared with an assigned desired value. If the current gradient GN is smaller or equal to the assigned desired value, then a faulty or disturbed heating process is detected. The desired value can also be a previously determined gradient GN-1. In the embodiment the faulty heating process corresponds to a dry heating process, i.e. a cooking vessel 6 absorbs little power and the cooking product in the vessel 6 has almost completely boiled away. Then, in step 500, an alarm is triggered and/or the power supply is reduced and/or the power supply 4 is disconnected. If it is established in step 400 that the current gradient GN of the temperature profile exceeds the predetermined threshold, then in steps 600 to 640 the nature of the current, normal heating process is determined, in that the current gradient GN is compared with the gradient GN-1 determined on previously ending the power supply.

If the comparison in step 600 reveals that the current gradient GN is higher than the earlier gradient GN-1, then a first heating process 610 is detected. At the latter the cooking product in the cooking vessel 6 has not yet completely boiled, because said vessel 4 with the cooking product still absorbs much power from the hob 1 and the sequence starts again. If the current gradient GN does not exceed the earlier gradient GN-1, then continuation takes place with step 620.

If the comparison in step 620 reveals that the current gradient GN and the earlier gradient GN-1 are identical, then a second heating process is detected, in which the cooking product is boiling, i.e. 630. This is due to the fact that the power consumption of the cooking vessel with the cooking product is virtually identical over a longer period of time and the sequence starts anew.

If the two gradients GN and GN-1 are not identical, it is then established in step 640 that the current gradient GN is smaller than the earlier gradient GN-1. A third heating process is detected in which the cooking product in cooking vessel 6 has boiled away, because the vessel 6 with the cooking product only absorbs a small amount of power. The sequence then starts anew. This step is obviated, if the earlier gradient GN-1 is used as the assigned threshold.

Figure 3:
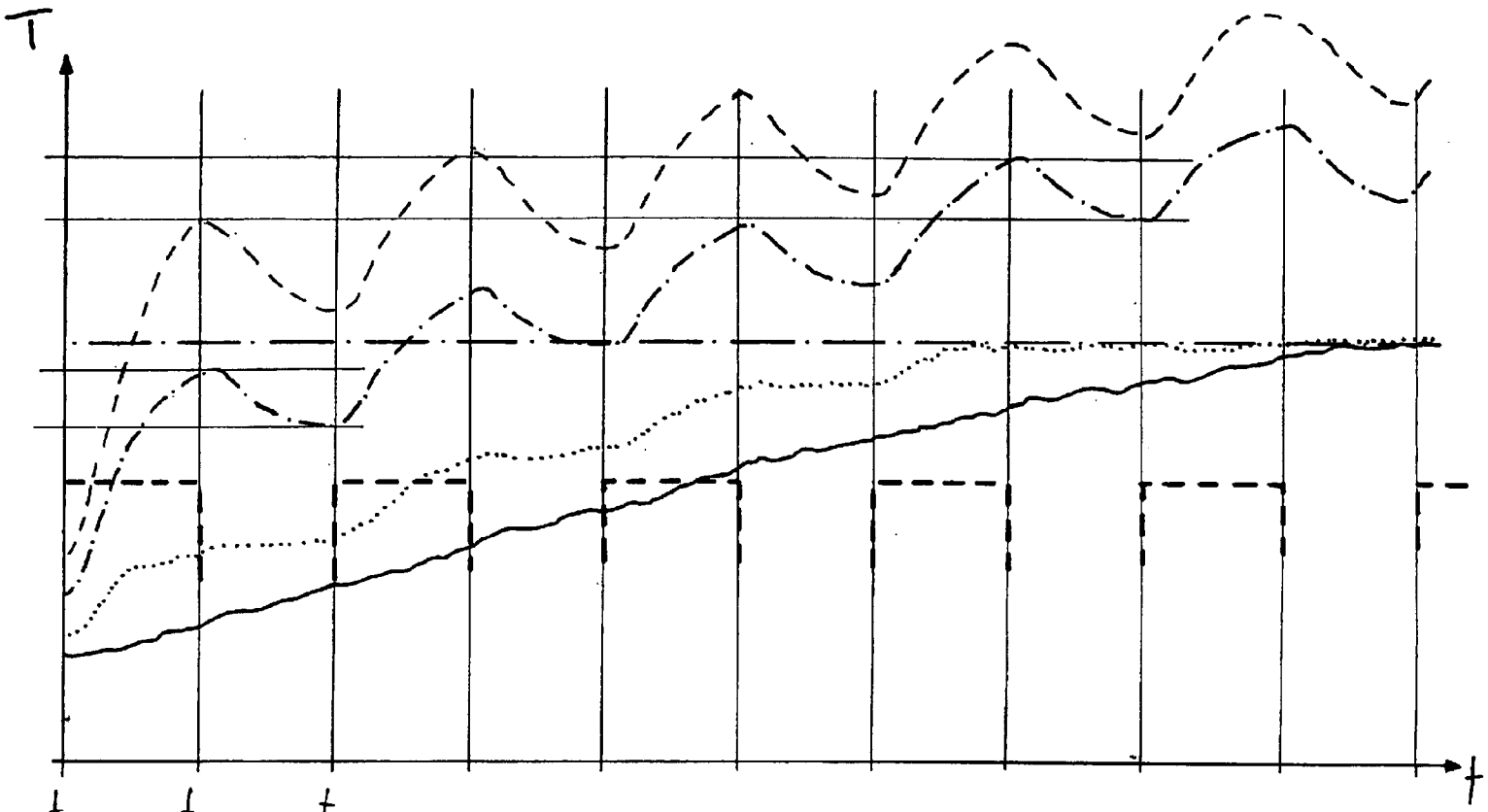
FIG. 3 A temperature-time diagram.

FIG. 3 is a diagram or graph showing the different temperature profiles over time. In continuous line form is shown as a rising curve the temperature of the cooking product. In dotted line form is shown the saucepan bottom temperature. The dot-dash, jagged curve roughly corresponds to the hob temperature and the dashed, jagged curve roughly corresponds to the heater temperature. However, in connection with these two curves it must be borne in mind that this representation does not necessarily correspond to the absolute temperatures, but instead more particularly reproduces the diagrammatic pattern. These temperature profiles are evaluated in the manner described hereinbefore.

The horizontal, dot-dash line is the temperature T, which the cooking product reaches after a certain time. When water is the cooking product this is 100° C. In addition and with the same time intervals are drawn in broken line rectangles representing the operation of a heater, e.g. a radiant heater. Thus, in the embodiment shown use is made of a heater with fixed cycle or cyclic operation and alternation between low power and full power, as well as regular cyclic operation.

Initially, during a cycle or heating period in particular the heater temperature will rise sharply, as will that of the hob. The saucepan bottom temperature rises more slowly and that of the cooking product even more slowly.

At the end of the first heating cycle time, the heater temperature no longer rises and that of the hob for only a short time. The temperature profile of the saucepan bottom flattens, whereas the temperature profile of the cooking product remains essentially the same. During the unheated interval the temperature curves of the heater and hob clearly drop, whilst the saucepan bottom temperature rises slightly, as does that of the cooking product.

At the start of the next heating interval, the heater and hob temperatures again rise rapidly and steeply, whereas that of the saucepan bottom rises less steeply and that of the cooking product even less steeply. In connection with the cooking product temperature it can be generally stated that it rises substantially uniformly over the time path of the entire heating process and in particular independently of the heating intervals.

Following the end of the next heating interval, substantially the same picture arises as after the end of the first heating interval and this also applies to the following heating intervals. From the magnitude of the drop of the hob temperature curve it is possible to calculate the given rise. From this conclusions can be drawn about the curve. Through further comparison it is possible to establish whether the differences or differential values are still within an assigned amount.

If the saucepan now boiled empty, particularly in the case of heating or boiling processes using water, it would once again be possible for the saucepan bottom temperature to rise or exceed 100° C. This would mean that the empty saucepan can absorb less heat from the heater and the hob. Consequently their temperatures also rise in absolute terms. In addition, the curve portions when during an unheated time the curves drop are much flatter, because less power can be absorbed and consequently the hob temperature drops less. A complete avoiding of the dropping of the hob temperature during an unheated time is scarcely technically and physically possible, but the temperature difference would be much smaller.

In connection with the further time pattern it can be stated that in the direction of very long times all the curves would have a constant or regular configuration and this would apply for as long as there is still cooking product in the saucepan.

If as the assigned threshold use is made of the previously determined gradient GN-1, then the alarm is triggered at time tn+1, because the temperature profile gradient in time interval TN1 between times tn+1 and tn+2 is smaller than in the case of the previous time intervals after ending the power supply.

In the embodiment shown in FIG. 3 the power supply is cyclically controlled. The control of the time intervals for power supply and the time intervals without power supply is brought about by control means 2 using a clock signal. The situation could also be different, as a function of the chosen power stage. In addition, in the embodiment shown, the control means terminates the power supply when the hob temperature reaches an assigned value. The power supply is reactivated at the next activation time.

If an interval following the ending of the power supply is too short for the measurement, then with a specific timing, i.e. not on each occasion, it is possible to extend the off-time. This extension must be sufficiently long to ensure that the off-time is adequate for the temperature drop.

The assigned temperature value is e.g. a maximum possible temperature value. This can be assigned in order to protect the cover against permanent damage. However, it can also be a temperature value assigned by the user by means of a control panel 5.

The embodiment also comprises a not shown alarm device, which is activated by the control means after a faulty heating process has been detected. It is e.g. placed in the control panel in the form of an acoustic alarm.

Apart from activation, in the embodiment shown, the control means disconnects the power supply when a faulty heating process has been detected. However, it is also conceivable for the control means to reduce the power supply before the assigned threshold is reached when the current gradient GN decreases compared with an earlier gradient GN-1. In an advantageous embodiment the assigned threshold, as stated, corresponds to the previously determined gradient GN-1.

What is claimed is:

1. A method for detecting a heating process in a hob, said hob having a cover and a heater beneath said cover for supplying power to a cooking or boiling vessel being placed on said cover, said power supply taking place at intervals and during a heating process a cover temperature profile is measured and evaluated, wherein said temperature profile after ending said power supply interval is detected and evaluated and for evaluation purposes a temperature profile gradient is determined and a threshold is determined, wherein during evaluation a normal heating process is detected if said temperature profile gradient exceeds said threshold and during evaluation a faulty heating process is detected if said temperature profile gradient is equal to or smaller than said threshold.

2. Method according to claim 1, wherein said power supply takes place in cyclic manner at intervals.

3. Method according to claim 2, wherein said power supply takes place in cyclic manner at intervals with an assigned power and substantially fixed cycle times, which are dependent on the level of said in each case chosen power supply.

4. Method according to claim 1, wherein after a faulty heating process has been detected, an action from the following group is initiated: an alarm, a power supply reduction and a disconnection.

5. Method according to claim 1, wherein said threshold is determined from an earlier gradient of an earlier ending of said power supply and during evaluation the current gradient is compared with said threshold.

6. Method according to claim 5, wherein said earlier gradient forms said threshold.

7. Method according to claim 5, wherein during a first heating process a cooking product in said cooking vessel is not yet boiling and during evaluation said first heating process is detected if said current gradient exceeds said earlier gradient.

8. Method according to claim 5, wherein during a second heating process a cooking product in said cooking vessel is boiling and during evaluation said second heating process is detected if said current gradient and said earlier gradient are virtually equal.

9. Method according to claim 5, wherein in a third heating process a cooking product in said cooking vessel has boiled away and during evaluation said third heating process is detected if said current gradient is smaller than said earlier gradient.

10. Method according to claim 1, wherein a sensor for detecting said temperature is placed on the same side of said cover as said heater.

11. Method according to claim 1, wherein on determining said gradient of said temperature profile several points are measured at time intervals, on the one hand shortly before an end of said power supply and on the other shortly before a recommencement of said power supply.

12. Method according to claim 1, wherein on determining said gradient of said temperature profile several points are measured at time intervals, on the one hand shortly before an end of said power supply and on the other a fixed time following the end of said power supply.

13. Device for detecting a heating process in a hob, which has a cover and a heater beneath said cover for power supply to a cooking or boiling vessel placed on said cover, said power supply taking place at intervals and a control means is provided for said heater, said control means being constructed for evaluating a measured temperature profile and a temperature sensor is provided on said hob and it measures a temperature profile of said cover during a heating process, wherein said control means is constructed in such a way that it evaluates said temperature profile after ending said power supply and for evaluating purposes determines a gradient of said temperature profile, whilst during evaluation said control means detects a normal heating process if said gradient exceeds a predetermined threshold, and detects a faulty heating process if said gradient is equal to or smaller than a predetermined threshold.

14. Device according to claim 13, wherein an alarm device is provided and said control means activates said alarm device after a faulty heating process has been detected for the purpose of giving an alarm.

15. Device according to claim 13, wherein a switching device is provided, said control means activating said switching device after a faulty heating process has been detected for the purpose of reducing said power supply.

16. Device according to claim 13, wherein said temperature sensor is fitted to the same side of said cover as said heater.

* * * * *